US008191853B2

(12) United States Patent
Long, Sr.

(10) Patent No.: US 8,191,853 B2
(45) Date of Patent: Jun. 5, 2012

(54) CONCRETE FORM HOLDING A PARTIAL SHEET OF INSULATION AT A PRESELECTED POSITION THEREIN

(75) Inventor: Robert T. Long, Sr., Ames, IA (US)

(73) Assignee: Composite Technologies Corporation, Boone, IA (US)

( * ) Notice: Subject to any disclaimer, the term of this patent is extended or adjusted under 35 U.S.C. 154(b) by 157 days.

(21) Appl. No.: 12/348,665

(22) Filed: Jan. 5, 2009

(65) Prior Publication Data

US 2009/0173870 A1 Jul. 9, 2009

Related U.S. Application Data

(60) Provisional application No. 61/010,121, filed on Jan. 4, 2008.

(51) Int. Cl.
*E04G 11/06* (2006.01)

(52) U.S. Cl. ..... 249/40; 249/84

(58) Field of Classification Search ..... 52/309.9, 52/309.12, 309.17; 264/35; 249/40, 43, 249/84, 85, 91, 96, 97
See application file for complete search history.

(56) References Cited

U.S. PATENT DOCUMENTS

| | | | | |
|---|---|---|---|---|
| 2,718,138 | A * | 9/1955 | Jones | 52/381 |
| 3,438,161 | A * | 4/1969 | Koch | 249/40 |
| 4,329,821 | A * | 5/1982 | Long et al. | 52/309.12 |
| 4,393,635 | A * | 7/1983 | Long | 52/309.12 |
| 4,541,211 | A * | 9/1985 | Garrett | 52/309.12 |
| 4,669,234 | A * | 6/1987 | Wilnau | 52/98 |
| 5,987,830 | A * | 11/1999 | Worley | 249/40 |
| 6,854,229 | B2 * | 2/2005 | Keith et al. | 52/309.12 |

* cited by examiner

*Primary Examiner* — Michael Safavi
(74) *Attorney, Agent, or Firm* — Brick Gentry PC; Brian J. Laurenzo

(57) ABSTRACT

A concrete forming apparatus having an inside form panel and an outside form panel spaced opposite from the inside form panel to create a gap into which plastic concrete will be placed and cured. A sheet of rigid insulation of a reduced height less than the height of the form panels is placed in the gap. A plurality of tie sleeves are pre-inserted through the insulation at regular intervals. A plurality of form ties are releasably connected to at least one of the form panels and extended through the tie sleeve to support the reduced height sheet of insulation at the desired vertical position. The tie sleeve strengthens the insulation in the area of the form tie and prevents damage to the insulation and prevents vertical movement of the insulation during placement and curing of the plastic concrete.

8 Claims, 5 Drawing Sheets

CONCRETE FORM HOLDING A PARTIAL SHEET OF INSULATION AT A PRESELECTED POSITION THEREIN

The present application claims priority to the application Ser. No. 61/010,121 filed Jan. 4, 2008, which is herein incorporated by reference in its entirety.

BACKGROUND OF THE INVENTION

The invention relates generally to concrete forming apparatus and, more specifically, to apparatus for holding a partial sheet of insulation at a preselected position inside a concrete form.

Concrete forming systems are in wide use in forming concrete structures. One application is in the formation of insulated concrete walls. A common system erects a concrete form on footings wherein a pair of form panels are separated by a gap into which concrete is placed to form a wall. Insulation is often placed in the gap prior to the addition of the concrete so that the wall has improved thermal properties as taught in U.S. Pat. Nos. 4,329,821 and 4,393,635 (both to Long et al.), both of which are herein incorporated by reference. A plurality of spacing elements, usually forming a part of the insulation, maintains the insulation within the gap between the form panels so that a layer of concrete is formed on either side of the insulation. The most common insulation used is lightweight, rigid foam sheets that, most typically, extend the fall height of the concrete form panels. Currently these insulation sheets sit on the same bottom surface that the forms sit on to support the insulation height and to prevent the insulation from being forced downward by the force of placing the plastic concrete to a point that would place the top edge of the foam below the top edge of the form. Additionally, these insulation sheets are buoyant and float upwardly as the plastic concrete is placed in the gap and therefore need to be held down by straps or similar structure placed on top of the form panels. There are times, however, where it is desired to use a foam sheet that is not the full height of the concrete form.

If a partial sheet of insulation is desired, the conventional method of placing the insulation and pouring the concrete requires placement of the concrete up to a certain height and then concrete pouring is interrupted so that the partial height insulation sheet can be placed in position and concrete pouring is resumed. But with this method, the rigid foam insulation floats up as additional concrete is placed adjacent to the insulation due to hydrostatic pressure. The other short coming of this method is that it is very difficult to achieve the correct height for the lower portion of the concrete in which no insulation is present. The present invention overcomes these shortcomings by suspending the less than full height rigid insulation sheets in the concrete formwork with the use of tie sleeves.

SUMMARY OF THE INVENTION

The invention consists of concrete forming apparatus used to hold a sheet of rigid insulation in position that is less than the height of a concrete wall being formed. A plurality of tie sleeves are pre-inserted into the insulation sheet at spaced intervals across the area of the sheet. Form ties which extend through the tie sleeves to either side of the insulation sheet. The ends of the form ties are releasably attached to the concrete form panels and hold the insulation sheet in a predetermined position during placement and curing of the plastic concrete. Without the tie sleeves, the form ties will cut through the rigid insulation when the concrete is poured on either side of the rigid insulation.

BRIEF DESCRIPTION OF THE PHOTOGRAPHS AND DRAWINGS

DESCRIPTION OF THE INVENTION

Figure 1:
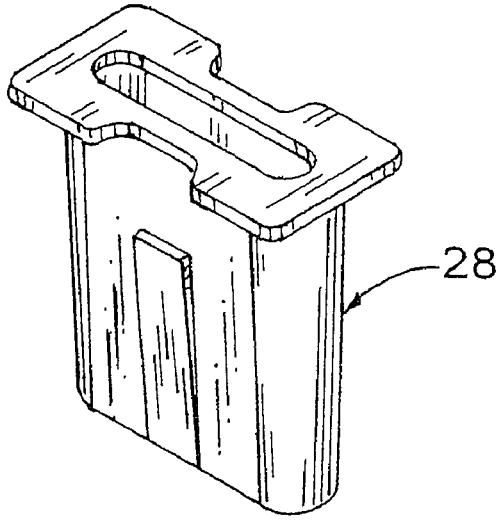
FIG. 1 is a drawing of a tie sleeve of the present invention.
Figure 2:
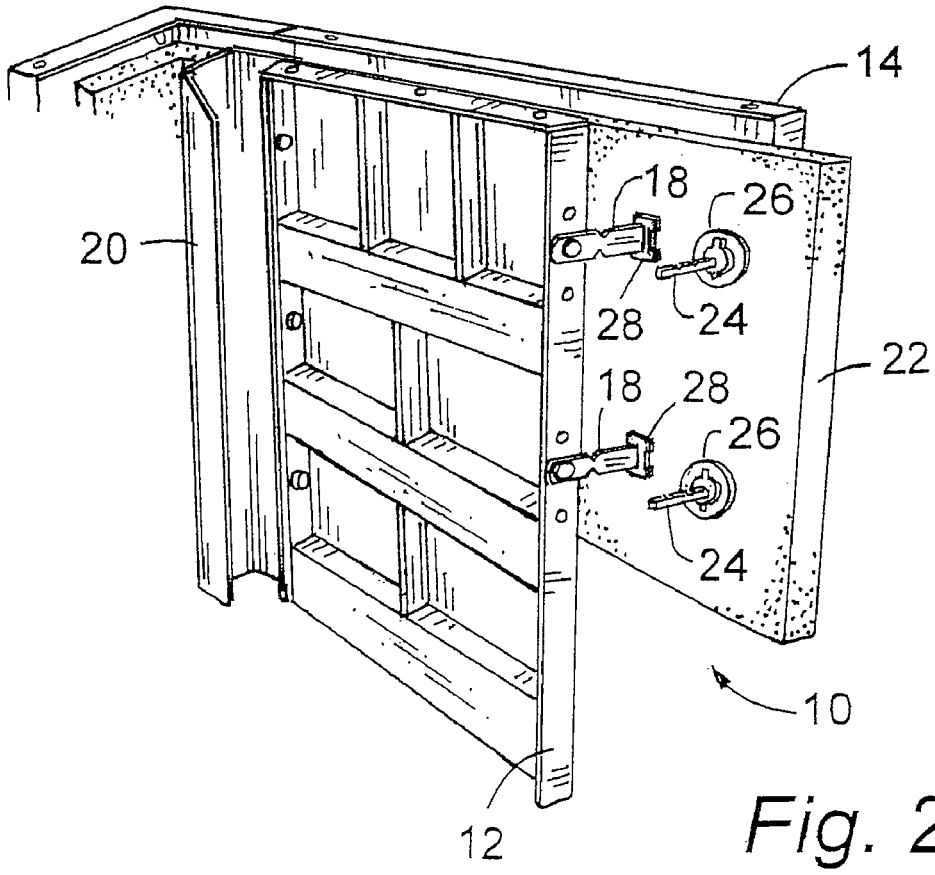
FIG. 2 is a perspective view of a concrete wall forming apparatus incorporating the present invention.
Figure 3:
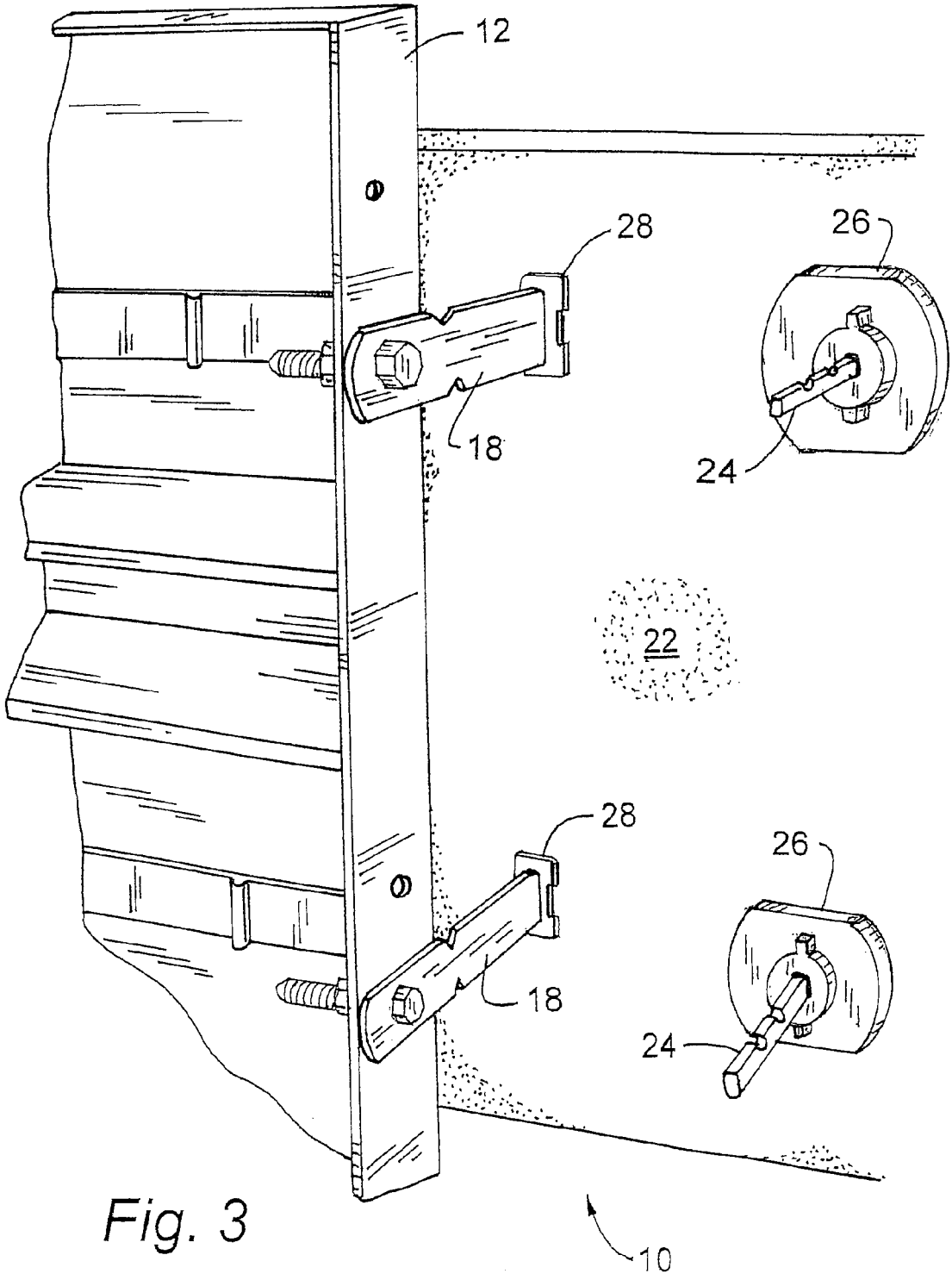
FIG. 3 is a close up of FIG. 2.
Figure 4:
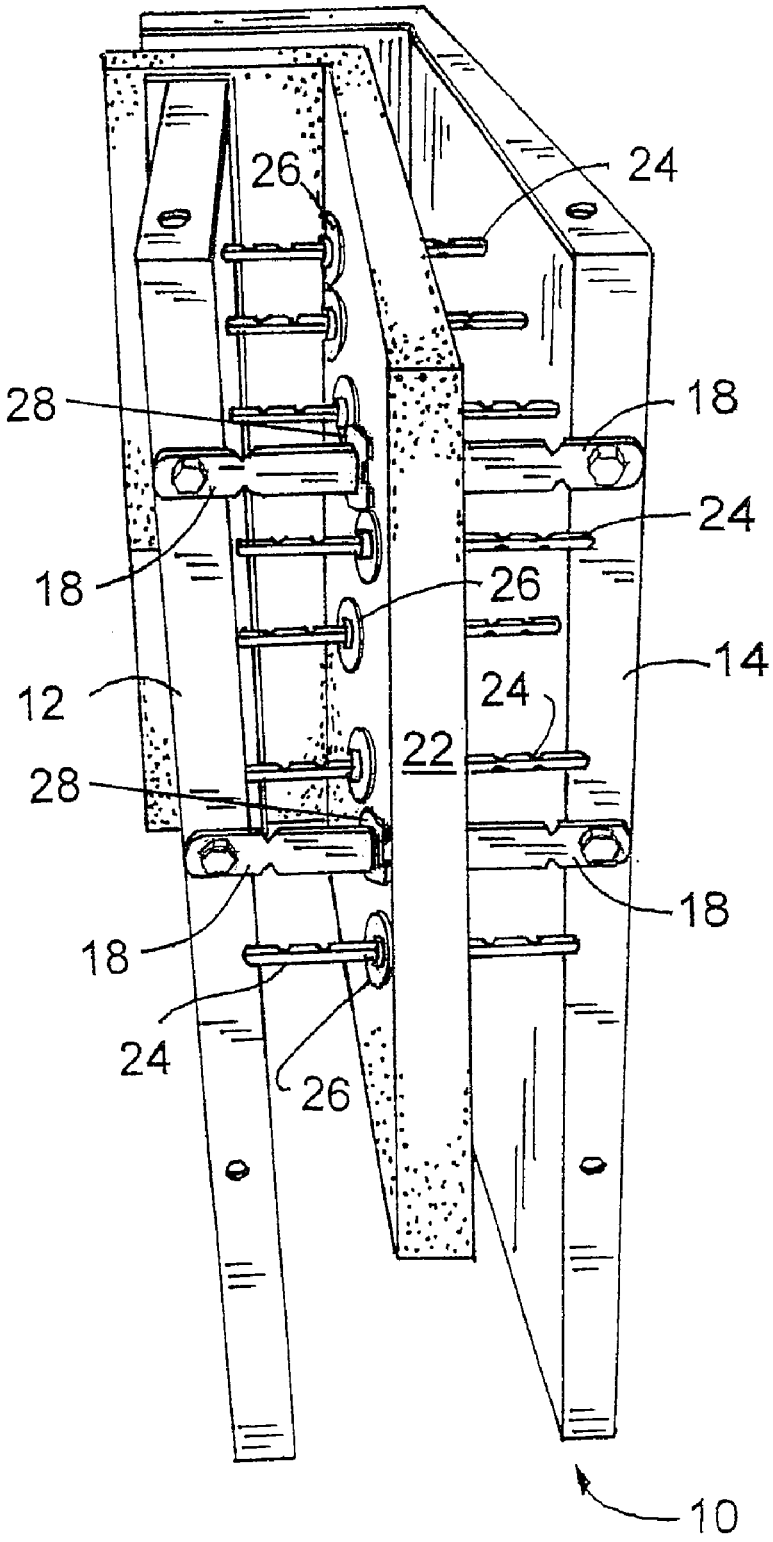
FIG. 4 is an upper end view of the apparatus of FIG. 2.
Figure 5:
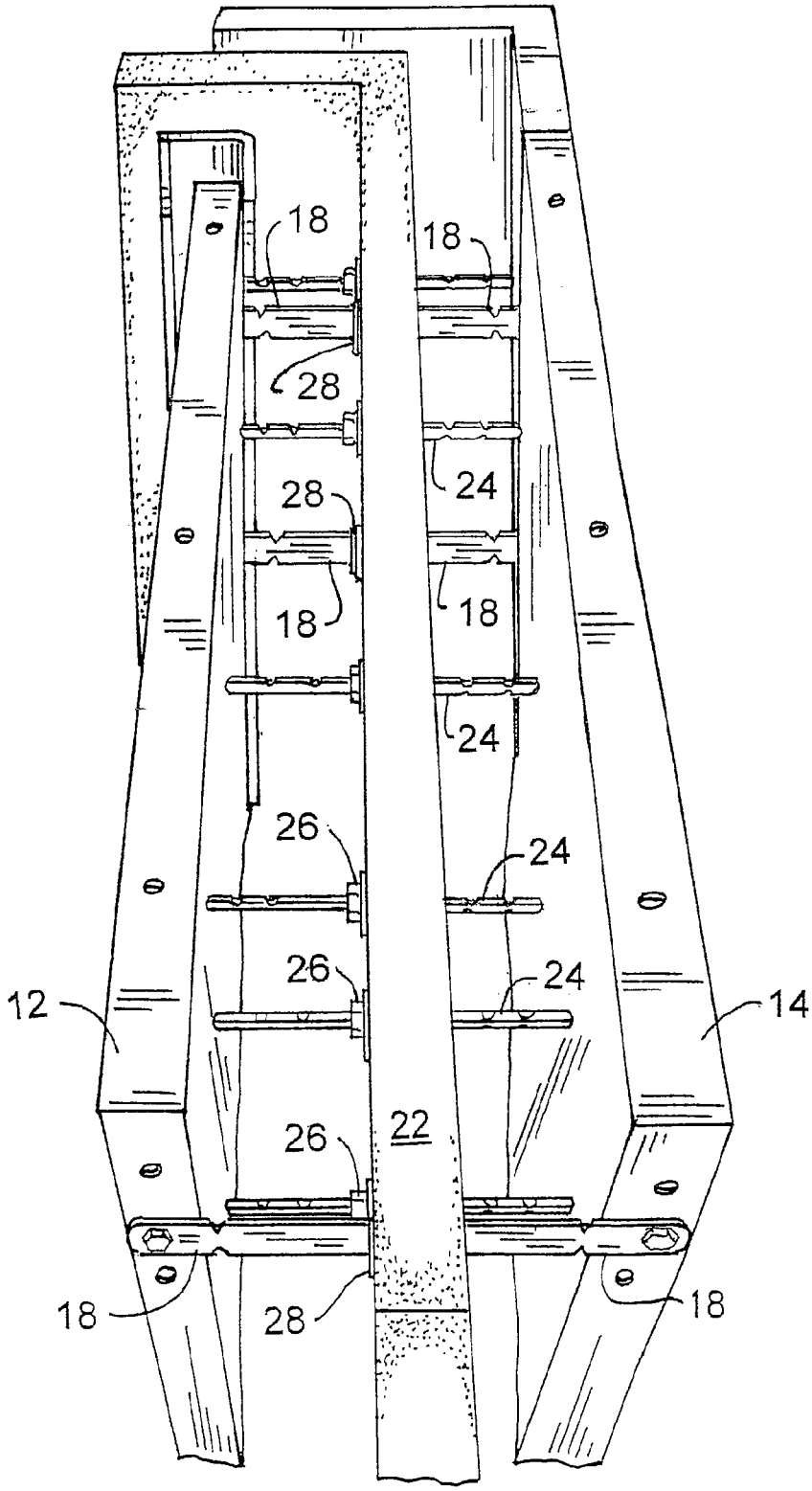
FIG. 5 is a higher perspective view of the apparatus and looking downward into the apparatus of FIG. 2.
Figure 6:
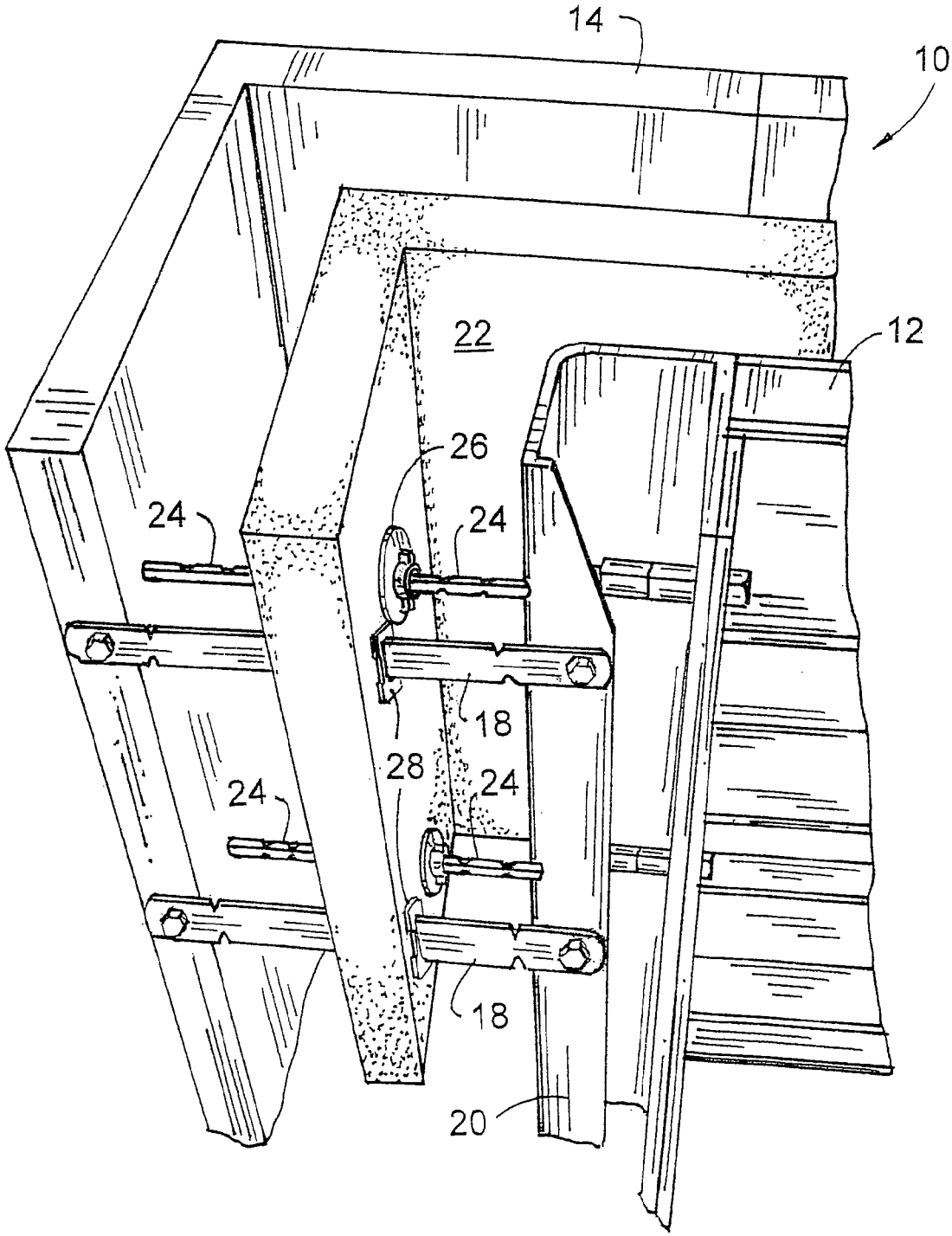
FIG. 6 is an upper side perspective view of a corner of the apparatus of FIG. 2.

Illustrated in FIGS. 2-6, generally at 10, is a concrete forming apparatus for forming a section of a wall including a corner. An inside concrete form panel 12 is supported in an upright position. An outside concrete form panel 14 is also supported in an upright position parallel to and spaced away from the inside concrete form panel 12. A plurality of form ties 18 extend between the two panels 12 and 14 to secure the panels to each other and fashion a strong, rigid form into which plastic concrete can be placed and cured. The particular apparatus 10 includes a second outside form panel section 20 that is used to form a section of a corner in the wall section being formed.

Interposed in the gap between the panels 12 and 14 is a section 22 of a rigid sheet of insulation. The sheet 22 is positioned centrally in the gap between the panels 12 and 14 by a plurality of rods 24 and spools 26 that are distributed at regular intervals across the sheet 22 in the conventional manner. As best seen in FIGS. 3-6, the rods 24 are of a length substantially equal to the gap between the form panels 12 and 14 so that the ends of the rods 24 are in contact engagement or nearly in engagement with the facing surfaces of the form panels 12 and 14 and so as to hold the insulation sheet 22 at the preselected position centrally and upright in the gap. The insulation sheet 22 may also be offset if an unbalanced wall configuration is necessary.

The form tie sleeve 28 allows lateral movement or sliding of the of the insulation sheet 22 along the form tie. Accordingly, the insulation sheet 22 may be placed at any position between the inside concrete forming panel 12 and the outside concrete forming panel 14.

The partial sheet 22 does not extend the full height of the form panels 12 and 14. While the rods 24 and spools 26 function to hold the lateral position of the insulation sheet 22, they do not hold the vertical position of the sheet 22. To prevent vertical movement of the partial sheet 22 during placement and curing of the plastic concrete, a plurality of form ties 18 extend through the partial sheet of insulation 22. At each form tie location, a form tie sleeve 28 (shown in detail in FIG. 1) is pre-inserted into the insulation 22 to strengthen the insulation 22 in the area of the form tie 18 so that the insulation 22 does not tear, slice or deform as the plastic concrete is being placed and cured. The form tie sleeve 28 anchors in the insulation 22 and stays in place during the pouring of the concrete. The sleeve 28 is made from a substantially rigid material, such as thermoset or thermoplastic polymer material, fiber reinforced polymer, or metals. The form tie sleeve 28 of a shape that distributes the load over larger area within the rigid material A particular application of the present invention is in the formation of basement walls for residential housing. It is common to form a solid, uninsulated concrete wall below grade and place insulation on the outside of the cured wall prior to backfilling. If, however, the grade is below the top of the wall, foam insulation on the outside of a solid concrete wall will extend above ground. This causes several problems. First, such insulation is subject to damage by accidental contact during further construction of the residence and by normal outdoor activities throughout the life of the residence. Additionally, foam insulation is subject to degradation by UV light and so must be covered if above grade. Or alternatively, the above grade portion of the solid concrete wall is left un-insulated if the exterior insulation is stopped at ground level resulting in an enormous thermal bridge through the wall section. The present invention allows builders to use current practice of installing insulation on the outside of a wall where it will be below grade and also integrally insulate the portion of the wall that is above grade by casting insulation into the wall in the areas that will be above grade, thereby insulating the full vertical height of the wall.

The foregoing description and drawings comprise illustrative embodiments of the present inventions. The foregoing embodiments and the methods described herein may vary based on the ability, experience, and preference of those skilled in the art. Merely listing the steps of the method in a certain order does not constitute any limitation on the order of the steps of the method. The foregoing description and drawings merely explain and illustrate the invention, and the invention is not limited thereto, except insofar as the claims are so limited. Those skilled in the art that have the disclosure before them will be able to make modifications and variations therein without departing from the scope of the invention.

I claim:

1. A concrete forming apparatus, comprising:

(a) an inside form panel of a first height;

(b) an outside form panel of a second height spaced opposite from the inside form panel;

(c) a sheet of rigid material having insulation properties of a third height less than at least one of the first height and the second height;

(d) a tie sleeve inserted through the rigid material; and (e) a form tie releasably connected to at least one of the form panels and extended through the tie sleeve, wherein the tie sleeve is positioned to allow lateral movement of the sheet of rigid material and the tie sleeve along the form tie.

2. The concrete forming apparatus of claim 1, wherein the tie sleeve has anchoring properties to stay in the rigid material during the concrete pouring operation.

3. The concrete forming apparatus of claim 1, wherein the tie sleeve is comprised of a material selected from the group consisting of thermoset polymer material, thermoplastic polymer material, fiber reinforced polymer, and metal.

4. The concrete forming apparatus of claim 1, wherein the rigid material does not extend to a least one of the first form panel and the second form panel.

5. The concrete forming apparatus of claim 1, wherein the tie sleeve is shaped to prevent the rigid material from tearing, slicing, or deforming during the concrete pouring operation.

6. The concrete forming apparatus of claim 1, wherein the tie sleeve does not extend to the form panels.

7. The concrete forming apparatus of claim 1, wherein the rigid material is laterally offset between the inside form panel and the outside form panel.

8. The concrete forming apparatus of claim 1, wherein the rigid material can be positioned at any place between the inside form panel and the outside form panel.

* * * * *